US009032858B2

(12) United States Patent
Kellner et al.

(10) Patent No.: US 9,032,858 B2
(45) Date of Patent: May 19, 2015

(54) REACTIVE PROTECTION ARRANGEMENT

(75) Inventors: Gerd Kellner, Schramberg (DE); Gerhard Sailer, Paderborn (DE)

(73) Assignee: GEKE SCHUTZTECHNIK GMBH, Freiburg (DE)

( * ) Notice: Subject to any disclaimer, the term of this patent is extended or adjusted under 35 U.S.C. 154(b) by 34 days.

(21) Appl. No.: 13/816,854

(22) PCT Filed: Jul. 5, 2011

(86) PCT No.: PCT/EP2011/003330

§ 371 (c)(1), (2), (4) Date: Mar. 22, 2013

(87) PCT Pub. No.: WO2012/019677

PCT Pub. Date: Feb. 16, 2012

(65) Prior Publication Data

US 2013/0213210 A1 Aug. 22, 2013

(30) Foreign Application Priority Data

Aug. 13, 2010 (DE) ..... 10 2010 034 257

(51) Int. Cl.
*F41H 11/00* (2006.01)
*F41H 5/007* (2006.01)

(52) U.S. Cl.
CPC ..... *F41H 5/007* (2013.01)

(58) Field of Classification Search
USPC ..... 89/36.17, 36.02, 36.01
See application file for complete search history.

(56) References Cited

U.S. PATENT DOCUMENTS

| | | | | | |
|---|---|---|---|---|---|
| 3,592,148 | A | * | 7/1971 | Manis | 109/37 |
| 4,051,763 | A | * | 10/1977 | Thomanek | 89/36.17 |
| 4,368,660 | A | * | 1/1983 | Held | 89/36.17 |
| 4,498,677 | A | * | 2/1985 | Dapkus | 273/380 |
| 4,741,244 | A | | 5/1988 | Ratner et al. | |
| 4,981,067 | A | * | 1/1991 | Kingery | 89/36.17 |
| 5,577,432 | A | * | 11/1996 | Becker et al. | 89/36.17 |

(Continued)

FOREIGN PATENT DOCUMENTS

| | | |
|---|---|---|
| CN | 2 287 292 | 8/1998 |
| CN | 201302425 | 9/2009 |

(Continued)

OTHER PUBLICATIONS

Chinese Office Action corresponding to application CN 201180039671.3 dated Mar. 21, 2014.

*Primary Examiner* — Michelle R Clement
(74) *Attorney, Agent, or Firm* — Greer, Burns & Crain, Ltd.

(57) ABSTRACT

A reactive protection arrangement for protecting stationary or mobile objects against threats posed by hollow charges, projectile-forming charges or kinetic energy penetrators is secured to the side of the object to be protected that faces the threat in a fixed or movable manner, and includes at least one protective area arranged at an inclination angle to the threat direction. This protective area comprises a front cover that faces the threat, and a rear cover that faces away from the threat and is spaced apart from the front cover and, is configured as a bulging arrangement. At least one fixed or movable reactive middle layer or reactive zone is present between both covers which includes at least two reactive partial areas each having at least one explosive field, wherein the reactive partial areas are plugged on all sides by means of the delimiting covers as well as lateral separating layers.

17 Claims, 7 Drawing Sheets

(56) References Cited

U.S. PATENT DOCUMENTS

| | | | | |
|---|---|---|---|---|
| 5,637,824 | A | 6/1997 | Benyami | |
| 5,824,951 | A | 10/1998 | Tanaka | |
| 6,311,605 | B1 * | 11/2001 | Kellner et al. | 89/36.02 |
| 6,619,181 | B1 * | 9/2003 | Frey et al. | 89/36.17 |
| 7,540,229 | B2 * | 6/2009 | Seo et al. | 89/36.17 |
| 8,448,560 | B1 * | 5/2013 | Gonzalez | 89/36.17 |
| 2004/0050239 | A1 | 3/2004 | Benyami et al. | |
| 2004/0118273 | A1 * | 6/2004 | Zank | 89/36.17 |
| 2004/0237765 | A1 | 12/2004 | Schluter et al. | |
| 2006/0086243 | A1 * | 4/2006 | Seo et al. | 89/36.17 |
| 2006/0162539 | A1 | 7/2006 | Fucke et al. | |
| 2012/0031260 | A1 * | 2/2012 | Warren | 89/36.02 |
| 2013/0213210 | A1 * | 8/2013 | Kellner et al. | 89/36.17 |

FOREIGN PATENT DOCUMENTS

| | | |
|---|---|---|
| CN | 201488644 | 5/2010 |
| DE | 20 31 658 | 5/1972 |
| DE | 43 97 244 | 6/1995 |
| DE | 37 29 211 | 1/1998 |
| DE | 33 13 208 | 10/1998 |
| DE | 28 11 732 | 11/1998 |
| DE | 36 43 850 | 8/1999 |
| DE | 199 56 197 | 6/2001 |
| DE | 102 50 132 | 5/2004 |
| FR | 1288911 | 2/1961 |
| FR | 2803379 | 7/2001 |
| GB | 1547528 | 6/1979 |
| GB | 2 284 879 | 6/1995 |
| WO | 94 20811 | 9/1994 |
| WO | 2009 145827 | 3/2009 |

* cited by examiner

REACTIVE PROTECTION ARRANGEMENT

FIELD OF THE INVENTION

The invention relates to a reactive protection arrangement for protecting stationary or mobile objects against threats, which is effective in particular against hollow charges (HL threats), explosively-formed or projectile-forming charges (P charges) and kinetic energy penetrators (KE munitions).

BACKGROUND

In protection arrangements, a distinction must basically be made between arrangements that are perpendicular or inclined in relation to the threat, homogeneous (massive) and structured (comprised of several layers of protection). Another distinguishing feature is the manner of the protective effect. A distinction is here best made between passive, reactive, active and inert-dynamic configurations. Arrangements are referred to as reactive protection when pyrotechnic components are initiated by the incident threat, and as active armor given the controlled initiation of the latter. Protection arrangements are inert-dynamic when the protection or parts thereof are accelerated solely by the energy of the incident or penetrating threat. Bulging arrangements (bulging plate arrangements, bulging structures) represent one example of this.

Reactive arrangements against both hollow charges and kinetic energy penetrators have been known since the early 1970's, in which pyrotechnically accelerated elements laterally disrupt or deflect the incident or penetrating/piercing threat, thereby diminishing the penetrating power. Predominantly involved here are single or multi-layer, unilateral or bilateral linings of the explosive, most often with metal plates. Such arrangements are used in armored vehicles.

In reactive protection arrangements, the pyrotechnic component poses the main problem, in terms of both handling and the various loads placed on the structure to be protected or the battlefield following detonation (collateral damages). The quality of this type of protection is determined first and foremost by the amount of explosive used in the entire target, by the percentage of area detonated upon impact of the threat, and by structural measures.

In light of their very high penetrating power, antitank weapons equipped with a hollow charge warhead pose a main threat in particular to light to moderately heavy armored vehicles. PG 7 and lance warheads are here suitable as a reference for this weapons system. For example, protection against HL threats posed to moderately heavy armored vehicles with a baseline protection of approx. 30-50 mm armor steel equivalent with passive protection systems requires an additional area weight measuring on the order of 500 kg/m$^2$. Previously known reactive protection systems still require an additional area weight measuring on the order of 250 to 300 kg/m$^2$. Even using significant, reactively accelerated area masses cannot fully defend against the HL threats, since only a limited percentage of the hollow charge jet can be influenced by the disruptive actions. For this reason, about 20 to 30% of the hollow charge munition's power must still be compensated as residual power by the basic armor of the vehicle at the current level of protection technology. With respect to the mentioned HL threat, this still corresponds to a required basic protection measuring on the order of 60 to 80 mm armor steel equivalent.

In reactive systems, the effective components must be accelerated to speeds of several 100 m/s to still reach the hollow charge jets that impact at up to 10 km/h with laterally effective disruptive masses. To this end, the accelerated target plates must basically bridge the crater formed by the jet tip, so as to reach the penetrating jet from the side. The structural design of the arrangement and in particular its angle in relation to the threat are here the determining parameters. In a series of known configurations, multilayer as well as steeply inclined reactive protection structures yield a jet disruption that arises as rapidly as possible and remains effective over a longer period of time (or with a greater jet length). As a rule, however, this results in structures with a lot of explosive and a large installation depth in comparison to the covered area. In addition, the percentage of structurally necessitated areas or area masses increases (dead masses).

Since relatively large areas (on the order of 100 mm×300 mm) are made to detonate in conventional protection arrangements, the latter place a load on both the environment and their bearing structure. Such reactive armors already involve modules area(reactive area elements) with a delimited area size. In lighter combat vehicles, the use of reactive components is highly restricted or impossible due to the load imposed by the reactive system itself.

EP 1 846 723 B1, which relates to the reactive protection device known as"ERICA", describes and critically discusses other patent documents disclosing reactive components by way of example. Involved here are the documents U.S. Pat. No. 5,824,951 A, DE 37 29 211 C1, U.S. Pat. No. 4,741,244 A, DE 199 56 197 C2, DE 199 56 197 A1, U.S. Pat. No. 5,637,824 A, DE 37 29 211 C, WO 94/20811 A1, DE 33 13 208 C and DE 102 50 132 A1.

The protection arrangement described in EP 1 846 723 B1 itself consists of a carrier of any design that is inclined in the incident or effective range of the threat, to which pyrotechnic layers are applied on both sides. Initiating both layers generates shock waves and reaction gases, accelerating the latter both against and in the direction of the penetrating threat. At hollow charges, this disrupts both the front, powerful jet elements as well as a significant portion of the overall jet length. The pyrotechnic structure is here at least approximately in a state of dynamic equilibrium over the entire duration of effective action, and exerts no relevant or disruptive influence on the environment in terms of final ballistics.

OBJECT OF THE INVENTION

It is the object of the present invention to provide an improved reactive protection arrangement, with which for example also moderately heavy and only light armored vehicles having a correspondingly slight baseline protection can be protected against hollow charges.

SUMMARY

This object is achieved by a reactive protection arrangement comprising the features of claim 1. Advantageous configurations and further developments of the invention are subject-matter of the dependent claims.

The reactive protection arrangement for protecting stationary or mobile objects against threats posed by hollow charges, projectile-forming charges or kinetic energy penetrators, which is or can be secured at a distance to the side of the object to be protected that faces the threat, comprises at least one protective area arranged at an inclination angle relative to the threat direction, wherein this protective area comprises a front cover that faces the threat, a rear cover that faces away from the threat and is spaced apart from the front cover, as well as at least one fixed or movable reactive middle layer between the front cover and the rear cover, wherein the at least one reactive middle layer comprises at least two reactive partial areas each having at least one explosive field, and wherein the reactive partial areas of the at least one reactive middle layer are plugged on all sides.

The reactive protection arrangement according to the invention makes it possible to achieve the following advantages in particular:

- a low area weight;
- a very high effectiveness;
- an optimal adjustability to the area of the objects to be protected;
- the smallest possible detonating area;
- the reliable and very quick initiation of the impacted field;
- the prevention of any unintended initiation of adjacent fields;
- the prevention of any fragment load on the vehicle's environment;
- no limitation on the vehicle's mobility;
- as modular a design as possible, so that parts of the protection system can be attached or removed during the mission as the case may be;
- no hazard caused by the explosive on the vehicle;
- a prevention of the formation of ballistically effective fragments or the load on the environment caused by the development of the effect of the reactive middle layer.

Contrary to conventional protection devices, the present invention provides a protective design/protective concept that is in partial aspects at least equivalent to the known arrangements, while being clearly superior when viewed overall. The invention relates to a reactive protection arrangement partially lined with explosive, in which the incident threat as a general rule only triggers a comparatively small part of the overall area, and thus in particular causes little if any lateral damages. Such a reactive protection device combines a very high effectiveness with a minimal detonating explosive area.

The reactive protection arrangement is or can be fixedly or detachably secured to a side of the object to be protected that faces the threat, and comprises at least one reactive protective layer that is inclined relative to the threat and has special design features. This reactive protective layer is in turn bordered in the threat direction by a front cover (as a rule a flat element), and on the rear side by a rear cover/protective plate/bulging plate. The reactive layer comprises explosive-comprising partial fields/partial areas, which each extend over a portion of the protective layer.

According to the invention, plugs are provided on all sides of the reactive coverage/partial coverage of the protective area (lining of the explosive area or explosive field), wherein specific (special, characteristic) properties are assigned to the type of this plugging. Contrary to a conventional explosive coverage extending over the entire area to be protected, this yields a protection arrangement that exhibits special protective properties owing to configuration and technical design.

The present invention is based on the way in which the individual explosive-comprising active fields are plugged. The term "plugging" will be explained below to provide a better understanding of the reflections set forth in this conjunction.

In the reaction of an explosive body, a distinction is basically made in terms of the arising reaction kinetics between combustion, deflagration, regional detonation (outgoing detonation after a specific propagation) and detonation (detonation penetrating through the entire body). Important with respect to the ensuing reaction is the process involving the dissociation of the explosive, i.e. its chemical conversion into the reaction components. This conversion is affected or determined quite decisively by external influences/parameters in the form of the "plugging" (embedding, spatial limitation/boundary) of the explosive body. "Plugging" must here be understood as how an explosive volume is embedded in the course of its conversion. A distinction must here also be made between a static plugging (no changes in the reaction-influencing boundary) and a dynamic plugging, in which the outer influencing parameters change during the reaction of the explosive.

The effect of the reacting explosive on its environment (its housing, its boundaries, its covers) stems from the arising reaction gases and the shock load on the bodies/materials or areas surrounding the explosive. How the shock energy transitions at the interface between explosive and boundary wall is in turn crucial with respect to the shock load. Another influencing variable involves the transport/the continuation/the propagation of the shock or shock energy both in the explosive volume not yet participating in the reaction (reached by the reaction front) as well as in the surrounding medium.

The all-around plugging of the reactive partial areas of the at least one reactive middle layer of the at least one protective area is achieved by the front cover, the rear cover, as well as by a lateral plugging of the partial areas.

The special advantage to arrangements according to the invention in comparison to previously known reactive protection structures may be gleaned from the above terms and their definitions. For example, plugging the explosive area or explosive field on all sides causes, immediately after the hollow charge jet has impacted, its complete and optimal conversion. In this way, the protective elements to be accelerated can be accelerated in a short enough time to a speed high enough to allow them to laterally reach the HL jet, divert it and thereby decisively reduce its effect. The explosive plugged on all sides can convert its entire pyrotechnic energy in the respective explosive field, and in so doing disrupt the threat to the greatest extent possible in relation to the introduced energy. The entire mass of the explosive in the reactive protection arrangement can be reduced considerably through the use of such protective elements (pyrotechnic partial areas) in comparison to the full-areal explosive coverage in terms of area distribution and necessary coverage thickness. In addition, the ability to freely select the used materials makes it possible to influence the shockwave propagation, and hence the dynamics of the process. Due to the partial area coverage also materials can be used that cannot be employed in conventional reactive armor due to their mechanical or dynamic properties.

The aforementioned EP 1 846 723 B1 sets forth basic deliberations about the achievable speeds of free and lined explosive areas by way of the Gurney equation for flat, pyrotechnic areas. According to the latter, speeds of up to 4 km/s theoretically result at a larger explosive thickness and relatively thinner layer to be accelerated. The free surface or a slight lining of the explosive surface determines whether the theoretically achievable speeds are approximated. Given very thin linings, area speeds on the order of 2 km/s are still reached even at small explosive thicknesses (for example, 2 mm). Such speeds are very high in comparison to conventional sandwich structures.

The values that arise according to Gurney depend in particular on the areas, since they are crucial with respect to effective plugging. Structures according to the present invention achieve correspondingly high lining speeds even at comparatively very small areas owing to optimal plugging of the explosive and material selection.

Aside from the minimally converted explosive mass, one special advantage to the protection arrangement lies in its multi-hit capability, i.e. its effectiveness against multiple threats. While the triggered protective element reduces the remaining reactive protective area based on its size, the very small area of this element in comparison to a full-areal explosive layer keeps the majority of the area to be protected reactively covered, and thus fully functional.

In an advantageous configuration of the invention, the explosive field can be filled with an insensitive explosive, which due to the optimal plugging can still be detonated through in a short enough time, and thereby also reaches a high protective efficiency. In the case of adjacent explosive fields, using such explosives makes it possible to give the plugging between the fields a correspondingly thin design to prevent the initiation of the adjacent field. In addition, using insensitive explosives simplifies the manufacture and handling of the protective layers, and hence of the entire protection arrangement.

Minimizing the detonating explosive masses in the individual fields makes it possible to also prevent the detonation from spreading to the adjacent field given comparatively thin (only several millimeters thick) lateral borders (plugging), even in the case of more active explosions. At the same time, such thin webs ensure that the protective performance remains uniformly high even given hits on the borders or webs. This also applies in cases where hits lie in the region where three or four partial fields converge. A corresponding geometric configuration of the individual fields (cf. e.g. FIG. 14) also enables the prevention of longer, line-type potential weak points.

Subject to compliance with design provisions relevant to effect, the process of dividing up the explosive-comprising area is left largely to the user. This holds true in particular with respect to the optimal distribution of protective fields, as well as to their subdivision or field size. The distribution can here be even or uneven. Also, the geometric configuration of the fields and structural design of the protective areas are broadly freely selectable. For example, strip-type, checkerboard, or otherwise arrayed area coverages can be realized in this way. Such distributions are interesting in particular with respect to multilayer coverages that are coordinated to each other.

When using bulging plates as accelerated protective elements, the latter are not subject to any limitation. Therefore, all previously known bulging plates or even bulging arrangements can be used for covering the reactive middle layer. In like manner, the carrier plate can be largely adjusted to system-dictated specifications or intended additional protective properties. For example, the latter can thus consist of lightweight metal, steel or a non-metallic material.

The laterally plugging of the explosive field/the explosive fields must be designed in accordance with the plugging-specific parameters. The dynamic effectiveness stems both from the physical/mechanical regularities as well as from the specific properties of the layers/interfaces involved relative to the passage of shockwaves.

The interfaces between the dynamic middle layer as well as the inner pluggings and the adjacent materials are here critical. The properties of the interface in relation to how the shockwaves pass are described by the so-called reflection coefficient (RK). The latter determines the reflectance of the shockwaves in the interface between two condensed media based on the correlation $RK=(m-1)/(m+1)$ with $m>1$ being the quotient of the products density ($\rho$) and longitudinal sound velocity/rod wave velocity (c) of the materials involved.

The passage of shockwaves in the boundary layer between both materials takes place without reflection when the products ($\rho \times c$) of the components are identical. Data for selected material pairings will be presented to provide a rough estimate ($\rho \times c$ of both materials; m; RK): St/Cu 4.1/3.3; 1.23; 0.11 (i.e. roughly 11% of the shockwave energy is reflected at the interface between steel and copper); St/Al 4.1/1.4; 11.7; 0.49 (reflectance about 49%); St/explosive 4.1/0.12; 33.9; 0.94 (reflectance 94%); Al/explosive 1.4/0.12; 11.7; 0.84 (reflectance about 84%); St/plastic 4.1/0.63; 6.54; 0.73 (reflectance about 73%); plastic/explosive 0.63/0.12; 5.25; 0.68 (reflectance about 68%). The portion of directly transmitted shockwave influence is to be correspondingly influenced via the material-specific properties of the laterally plugging webs and the covers of the explosive fields. This circumstance is also crucial with respect to the acceleration of lining materials, as well as to the achievable final velocities. Field tests with arrangements according to the invention have confirmed this.

In a preferred configuration, the pyrotechnic protective structure according to the invention consists of a carrier (rear cover) that is inclined in the incident or effective area of the threat and has whatever shape desired, to which is applied the at least one pyrotechnic protective area (reactive middle layer). Initiating the element/elements generates both shockwaves and reaction gases, which accelerate the linings both against and in the direction of the incident or penetrating threat. In the case of hollow charges, this diverts/disrupts both the front, powerful jet elements and a significant portion of the rear/residual jet length, thereby decisively diminishing the penetrating power of the threat. The pyrotechnic structure here only exerts little or no final-ballistically relevant or destructive influence on the environment, i.e. neither on the outer region/the battlefield nor on the structure to be protected.

Involved here is an extremely simple and basic protection arrangement, which essentially is not subject to any restrictions or limiting technical provisions. This yields a level of innovation hitherto not achieved by any previously known reactive protection arrangement. In addition, the suggested protective area is suitable for bringing about a sharp increase in the level of protection in a series of known armors through both offshore installation and integration.

Pyrotechnic protective areas according to the invention can essentially be combined with protection arrangements against P charges or KE threats. In each instance, low dead masses are required in optimizations against several threat types.

The essentially unrestricted design flexibility notwithstanding, a reasonable correlation between the involved parameters must of course be maintained. In conventional reactive armors, the effectiveness is vitally dependent on dimensioning requirements. In contrast, only a few preconditions must be observed in the present invention by virtue of the system. While these basically apply to all reactive arrangements, they can be in part more favorably configured in the arrangement according to the invention. For example, these include the minimum explosive thickness for ensuring a rapid initiation and a detonation that runs its course as fast as possible. The all-around plugging makes it possible to stay distinctly below the usual minimum values. Additional preconditions arise from the geometric circumstances and the correlation between the threat and protective area dimensioning. Consideration must here be given to the used materials, for example the type of explosive or corresponding admixtures, along with the number and arrangement of partial areas or protective areas.

Due to the configuration and high effectiveness, the explosive area to be applied, and hence the explosive mass to be expended per protective element, can be substantially lower in a pyrotechnic protective area according to the invention in comparison to previously known reactive armors. As demonstrated by numerous tests under realistic conditions, a sufficient protective performance can be achieved with partial areas measuring on the order of 30 mm×50 mm. This makes it possible to reduce the detonating explosive mass by a factor of 10 to 20 in comparison to conventional reactive protection arrangements. As a reference value for design purposes, it can be assumed that the thickness of the explosive coverages at an angle between the defended area and threat of over 45° can measure about 50% of the average jet diameter.

The explosive films or the linings can have variable thicknesses. For example, this makes it possible to influence the effectiveness of a partial area, e.g. to compensate for varying depths of protection or adjustments. Arrangements that exert a very wide range of actions at a high overall level of efficiency can arise in conjunction with disruptions to the rapid jet segments in the tip region caused by sufficiently high velocities and through suitable linings of the reactive components. Reference has already been made to the influence of shockwave transmission.

The depth of engagement can be increased, i.e. several jet particles, and thus a larger jet length, can be disrupted during passage through the target, by means of a thicker carrying layer or a separating layer between the explosive films with additional physical properties (for example in relation to dynamic behavior or specific properties involving shockwaves and their propagation). Known glass bodies dynamically compressed via explosives have a bearing on this type of structural design. However, the latter are relatively heavy in the known arrangements, not least due to the required thicknesses and associated lateral dimensions in the mass balance of an armoring. The intermediate layers in arrangements according to the invention have other objectives, and also are dimensioned completely differently.

In reactive armoring, the influence exerted by the element size or the accelerated area/partial area on plugging, and hence on the velocities achievable by the accelerated components, is of vital importance. This velocity reduction can measure on the order of 50%, so that this influence can overshoot other target specific parameters. At very low lining masses or given free explosive layers, the influence of element size diminishes accordingly. In first approximation, it has no influence on the velocity of gas plumes. This yields another advantage for arrangements according to the present invention. In particular the very important design points of module size and action in border zones are positively influenced. A multilayer structure for the carrier allows the latter to also serve as a control element for the energy and signal transfer between the individual protective components.

The explosive layers required in pyrotechnic protective areas according to the invention place only little demands on production tolerances, surface quality and manufacturing process. This greatly amplifies the leeway afforded when configuring the protective elements.

Another improvement stems from the basically known method for lining the areas of the pyrotechnic layers with materials varying in thickness and composition, up to and including a desired dynamic degradation properties. In addition to the usual materials for reactive arrangements, such as steel, titanium or duraluminum, such linings are advantageously also comprised of materials with a lower or higher density, materials that degrade or delaminate, plastics, composites or ceramics. Materials of interest from a physical standpoint include those that resist shock, but are soft at relatively low deformation rates, such as rubber or polymer materials. Metallic or nonmetallic foams are examples for suitable materials with a lower density than aluminum, while heavy metals, usually tungsten-based, can be used as higher density materials.

The application of model rules introduced in ballistics, in particular the Cranz model law, makes it possible to introduce geometric transfers within broad limits. As a consequence, a structural design tested in practice can be carried over to comparable applications within very broad limits based on physical and geometric mapping rules. Numerical simulations offer another aid for dimensioning and optimizing a protective structure.

The high effectiveness of an arrangement according to the invention essentially has nothing to do with the housing. Containers, housings or covers are used first and foremost for fixation purposes, or to protect the active layers against environmental influences. Also conceivable is an improved action in conjunction with additional protective components to be combined. It is basically advantageous in practice to link the operation of the protection arrangement with the structural specifications relating the object to be protected. This can range from simple placement all the way to mutually enhancing protective structures. Such system-side equipment can also be drawn upon to improve the protective performance of arrangements according to the invention, by having these components facilitate or support the breakdown of jet parts, for example. This can have an advantageous effect on the required target depth. The materials comprising the front and/or rear of the housing, any introduced carrying or fixing components, which can consist of one or more layers, must also be optimized with respect to their effectiveness against KE munitions and P charges.

In a preferred configuration, the layers made up of explosive and inert materials are introduced into prefabricated pockets of the protective areas or the protective module, as a result of which the reactive protection can be easily suitably adjusted in a manner suitable for production to the object to be protected.

The configuration of the protective area is completely optional. It is preferably an essentially flat area, but can also assume a curved or otherwise designed shape. It need only be sufficiently inclined relative to the threat direction in the effective portion. Due to the high efficiency of the pyrotechnic coverage, the minimum angle for the arrangement proposed herein is designed to be 10° to 15° less than in comparison to known reactive structures. Since sandwiches of conventional design proceed from a minimum angle of inclination measuring 45°, an average angle between the threat and defense measuring 30° to 45° is sufficient in the present arrangement. However, if realizable, larger angles also increase efficiency in this case too. The angle between the defended area and threat can be formed by adjusting the entire area or introducing geometric modifications in technical or structural measures. For example, an area not sufficiently inclined to be effective enough against a threat can be provided with the required inclination through corrugation, angular positioning or lamination. The varying configurations for pyrotechnic protective areas can here form an interconnected area, or be assembled out of individual modules, with gaps or other separations (for example, area segments, shutters, separate or intermeshing modules).

The technical configuration of the carrying element/carrying elements or covers for the protective area is essentially not subject to any limitations (e.g., metallic, non-metallic, structured, single- or multi-layer). The covers can be rigid or deformable/movable, and their thicknesses can range from that of films up to a massive plate or thicker structure.

The following features and advantages, at least some or all of which can be achieved in the protection arrangement according to the invention, will be emphasized once more:

- Lowest possible quantity of explosive required for reactive targets;
- Detonation of a minimal explosive mass;
- Highest possible handling safety for a reactively fitted protection;
- Individual fields plugged on all sides enable the use of inert explosives;
- Possibility for multilayer, combined structures;
- Individual fields plugged on all sides enable optimal acceleration of protective elements;
- Minimal load on both the object to be protected as well as the environment/battlefield;
- Flexible adjustment to the surface of the object to be protected;
- Best preconditions for retrofitting;
- Modular structure, i.e. components to be accelerated can be separated from the explosive layer;
- Less inclinations/adjustments than possible for conventional reactive armoring;
- Partial fields enable a multilayer [word missing] with varying reactive coverages;
- Only little or no performance loss due to edge hits or field edge hits.

The following preferred features can be realized individually or combined for a reactive protection arrangement according to the invention:

- The middle layer comprises two or more reactive partial areas or explosive fields plugged on all sides;
- The reactive partial areas of the at least one reactive middle layer are laterally plugged by separating layers or inner pluggings;
- The rear cover comprises at least one bulging arrangement;
- The at least one reactive middle layer is provided with a cover layer on one or both sides;
- The protective area comprises two or more reactive middle layers;
- The reactive partial areas are identical or different in size;
- The reactive partial areas have any geometry desired;
- The reactive partial areas of the at least one reactive middle layer comprise at least two plies with explosive fields plugged laterally on all sides;
- An intermediate layer is arranged between the explosive fields of two such plies of the reactive partial areas;
- The reactive areas of a middle layer have an identical or different structural design relative to each other;
- About 50% to 100%, preferably more than 65%, of the area of the at least one protective area is covered with plugged reactive partial areas;
- The inclination angle between the at least one protective area and threat direction ranges from about 30° to about 70°, more preferably from about 40° to about 60°;
- A protective thickness for an explosive field in the threat direction ranges from about 10 mm to about 14 mm;
- An intermediate layer is arranged between the reactive middle layer and the rear cover;
- The lateral plugging of the reactive partial areas comprises whatever cross section desired;
- The lateral plugging of the reactive partial areas consists essentially of a metallic or non-metallic material;
- The lateral plugging of the reactive partial areas is essentially homogeneous, or consists of a laminate or multilayer structure;
- The plugging separating layers of the at least one reactive middle layer comprise geometrically formed or inclined separating elements;
- A boundary layer is at least partially arranged between a reactive partial area and a separating layer that laterally plugs the latter in order to influence the boundary layer reflections;
- The reactive partial areas of the at least one protective area have an essentially checkerboard or strip-type arrangement;
- The protection arrangement comprises at least two protective areas arranged one behind the other in the threat direction with strip-type reactive partial areas, wherein the strips of the reactive partial areas of a rear protective area are offset relative to the strips of the reactive partial areas of a front protective area (preferably by the distance of one strip in the case of two protective areas);
- The protection arrangement comprises at least two protective areas arranged one behind the other in the threat direction with checkerboard reactive partial areas, wherein the reactive partial areas of a rear protective area are essentially offset relative to the reactive partial areas of a front protective area (in the case of two protective areas, the reactive partial areas of the front protective area preferably lie essentially over the inert partial areas of the rear protective area);
- The front and rear cover of the reactive middle layer or its reactive partial areas essentially consist of a metallic or non-metallic material;
- The front and rear cover of the reactive middle layer or its reactive partial areas are essentially homogeneous, or consist of a laminate or layered structure;
- The size of the front and rear covers of the reactive middle layer or its reactive partial areas essentially corresponds to the size of the explosive fields;
- The front and rear cover of the reactive middle layer or its reactive partial areas are single- or multi-layer (with or without intermediate layer(s));
- The front and rear cover of the reactive middle layer or its reactive partial areas project over the explosive fields of the reactive middle layer;
- The front and rear cover of the reactive middle layer or its reactive partial areas can be used in combination;
- A plurality of protective areas are arranged in the form of a shutter;
- A plurality of protective areas are arranged at an angle relative to each other;
- An additional layer for disrupting a (residual) threat penetrating through the at least one protective area is arranged between the at least one protective area and the object to be protected, with or without a gap relative to the object to be protected and/or the at least one protective area;
- The at least one protective area is movably arranged;
- The reactive partial areas of the at least one middle layer are replaceable;
- The reactive partial areas of the at least one middle layer are rotatable or have an adjustable inclination;
- The reactive partial areas and/or the explosive fields are pyrotechnically interlinked;
- The at least one protective area comprises a shell or a housing;
- The explosive fields are provided with a pyrotechnic or mechanical initiation aid;
- The sides of the front and/or rear cover facing the at least one reactive middle layer have been at least partially subjected to thermal and/or mechanical treatment;

The front cover essentially consists of a material that, in light of its thickness and/or its mechanical properties during the detonation of the explosive, is stamped out essentially corresponding to the size of the reactive partial area;

The at least one protective area forms a modular unit;

The front side and/or rear side of the at least one protective area comprises a cover layer;

The front and/or rear covers are joined with the at least one reactive middle layer by means of a screw connection, adhesive bond and/or vulcanization.

BRIEF DESCRIPTION OF THE DRAWINGS

The above and other features, advantages and possible applications of the invention will be illustrated more clearly by the following description of various exemplary embodiments along with more detailed descriptions of how individual components work and explanations of processes involving incident and penetrating threats based on the attached drawings (primarily as schematic sectional views), wherein:

FIG. 4A shows a rear cover of the reactive middle layer 11 by means of a homogeneous plate 9 to be accelerated, wherein a cover layer 11B is located between the plate 9 and the explosive area 11;

FIG. 4B shows a rear cover of the explosive-comprising area 11 by means of a bulging plate arrangement/bulging structure 10 consisting of the front plate 9, the rear plate 9A and an intermediate layer 9B;

FIG. 4C shows a rear cover of the explosive-comprising area 11 by means of a reactive, accelerated plate 9 and a bulging arrangement 10 spaced apart from the latter by an intermediate layer 35;

FIG. 5 shows a protective area 4 (here based on the example of FIG. 4) with the reactive partial areas 4A having a continuous/full-areal lining of both sides with areas 5 and 9 or 10 to be accelerated;

FIG. 6 shows a protective area 4 with segmented lining (partial area lining) by means of area elements 4A and a segmented lining of the front accelerated areas with partial areas 5A as well as a continuous/full-areal, rear lining 9, 10;

FIG. 7 shows a protective area 4 with a continuous, front, full-areal lining 5 to be punched through by detonating the explosive, and a segmented lining of the accelerated, rear partial area 9C, as well as a partial area layer 11C covering the explosive;

FIG. 8 is a sectional view of a protective area having a reactive layer 11 and geometrically configured, plugging lateral separating elements, wherein the arrangement according to FIGS. 3 and 4 is here provided with wedge-shaped webs 8A, a continuous front lining 5 and a bulging arrangement 10 as the rear lining;

DETAILED DESCRIPTION

Figure 1:
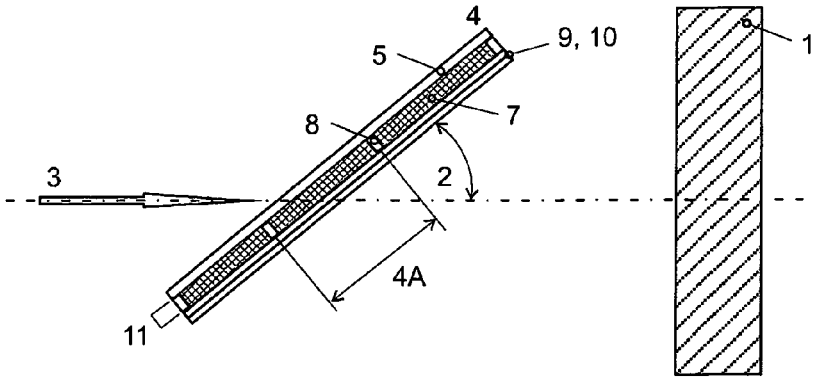
FIG. 1 is a schematic sectional view of the basic structure of a protection arrangement according to the invention with the object to be protected 1 and a protective area 4, as well as the reactive partial areas 4A of the reactive middle layer 11.

FIG. 1 shows a schematic side view of the basic structure of a protection arrangement according to the invention, with the object to be protected 1 and a reactive area 4 placed offshore/upstream from the latter, having the reactive partial elements/partial areas 4A, which contain the explosive fields 7 of the partial fields 4A. The layer 4 or fields 4A is/are plugged outside by the frame 6. The outer plugging by 6 is subject to the same physical rules and structural/system-related considerations as for the inner plugging 8, which will be explained below. At the same time, the frame 6 can be used to attach the protective area 4 to the surface of 1. Such a frame can also represent an autonomous element, in which one or more explosive-comprising layers can be introduced/inserted during assembly or given a modular construction. This provides an opportunity to load the protection arrangement with explosives only as needed.

The reactive protective area 4 is inclined at an angle 2 relative to the threat symbolized by the arrow 3. More detailed information has already been provided about the angle of inclination 2. The reactive middle layer 11 of the protective area 4 (see FIG. 2) is provided either partially or over its entire area with both front (facing the threat) and rear linings 5 or 9. The incident threat 3 initiates the corresponding/exposed explosive field 7, and accelerates the components 5 and 9. One special feature of the present invention is that, despite the small detonating explosive quantities, it provides multi-area/multilayer covers as well as protective combinations with special ballistic properties, such as bulging plates or bulging arrangements 10 (see FIG. 4), which are dynamically fully effective in comparison to conventional reactive protective structures, in addition to a single-area/single-layer rear cover.

Figure 2:
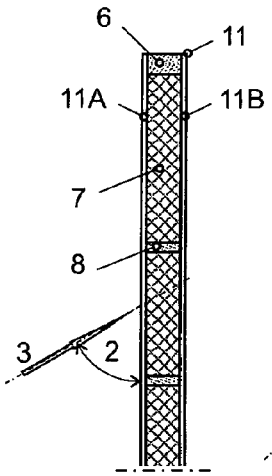
FIG. 2 are views of the basic structure of the reactive middle layer 11 with the front and rear cover layers 11A and 11B as components of the protective area 4.

FIG. 2 shows the basic structural design of a reactive layer 11 with the front and rear cover layers 11A and 11B as part of the protective layer 4 with reactive, plugged area elements 4A according to the invention. The layer marked 11 encompasses both the explosive/the explosive fields 7 with the inner plugging 8 (plugging between the explosive fields) as well as any provided front and/or rear covers/protective layers (11A and 11B). For example, the latter are used to protect the layer 11 or the fields 4A given a modular construction, in which such layers represent components that can be separately handled with the partial fields 4A. Also indicated is the upper, outer cover/the outer frame 6, which in this example is integrated into the layer 11.

The layers 11A and 11B are not intended to be autonomous linings in terms of components 5 or 9, but rather to be understood only as outer boundary layers of the explosive. This is why they were included in the drawings. In special cases, the layers 11A and 11B can be assigned special properties, for example as depicted on FIG. 4A. Given a modular construction, they can help impart mechanical stability to the layer 11. In borderline cases, they can also be viewed as a minimal plugging of the explosive fields 7. In like manner, the boundary layer 11A and/or 11B can influence the plugging of the explosive field 7 by way of its physical properties.

Figure 3:
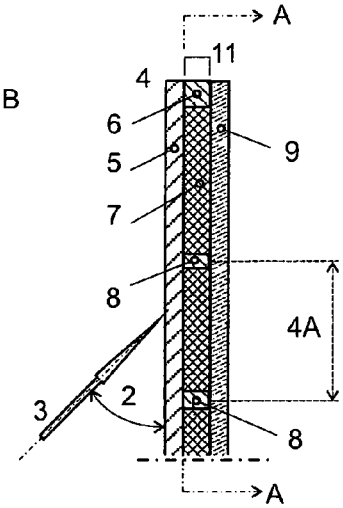
FIG. 3 are views of the structure with a front and rear accelerated, areal cover 5 or 9.
Figure 3:
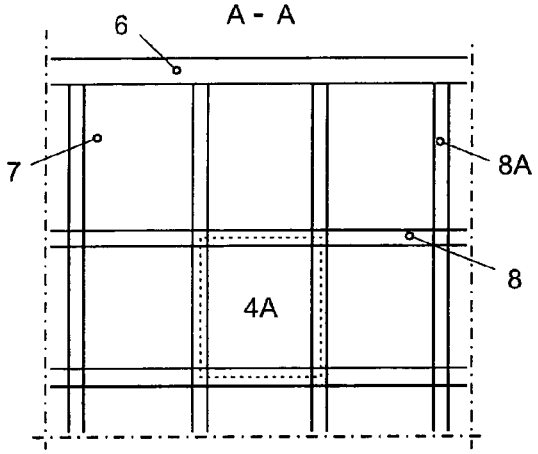

FIG. 3 shows a structural design according to the invention having the pyrotechnic layer 11 along with a front and rear accelerated, areal cover 5 or 9. The right side of the figure presents top view A-A. This view depicts the other types of plugging 8A, which in terms of their function correspond to plugging 8, but can exhibit other dimensions or even different properties (materials, structures). This is intended to illustrate that the inner, plugging grid or the inner, plugging strips or other geometric arrangements can essentially be freely configured largely independently of each other. They need only satisfy the requirement that the individual field size be as small as possible at an optimal functionality.

In order to reduce energy transmission by shockwaves into the adjacent fields, it may be best to introduce air gaps into the webs 8.

Figure 4A:
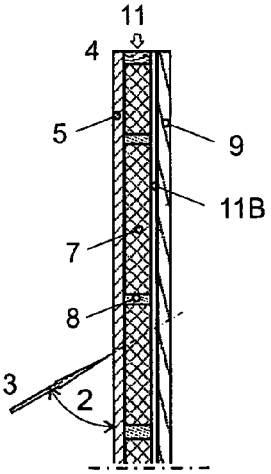
FIG. 4A to 4C show three examples for a protection arrangement with reactive area elements/protective areas 4 or partial coverages 4A and various back/rear linings/covers.
Figure 4B:
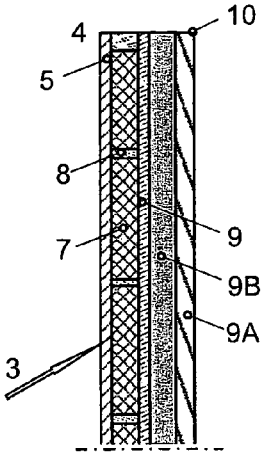
Figure 4C:
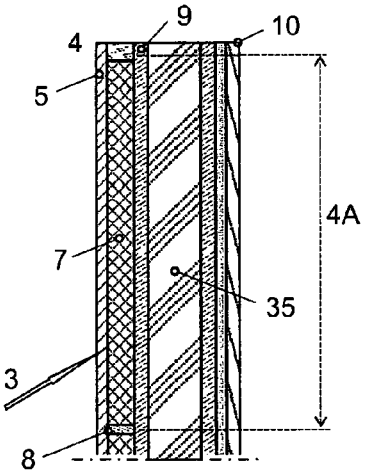

FIGS. 4A to 4C show three examples for a protective layer having reactive area elements/protective layers 4 or 4A and various, reactively accelerated rear (back, posterior) linings/covers. In the example of FIG. 4A, the rear cover of the reactive layer 11 consists of a plate 9 to be accelerated. Situated between 9 and the explosive plane of 11 is a cover layer 11B. 11B can be designed in such a way that this component in conjunction with 9 yields a bulging arrangement.

In the depiction of FIG. 4B, the rear cover of the explosive-comprising area 7 consists of a bulging plate arrangement/bulging structure 10 that is already known and has been in use for many years, which consists of the front plate 9, the rear plate 9A and a layer (insert) 9B located between these plates. The insert 9B is usually configured to be roughly as thick as the cover plate. In the present example, however, the layer 9B is thick in relation to the front and rear components, so as to create a greater, dynamically generated distance between the accelerated layers 9 and 9A as the bulging arrangement is accelerated by the detonating explosive 7. In this way it shall be achieved to disrupt the rear portions of the penetrating hollow charge jet over a prolonged period of time. In the case of penetrating kinetic energy munitions, the plate 9B can be adjusted in terms of thickness and material so as to effectively divert these types of threats as well. Experience shows that about 0.5 to 0.7 times the thickness of the diameter of the threat can be taken as a guideline for the thickness of the plate 9B.

For the following examples, the arrangements essentially to be classed with the bulging plates or bulging arrangements, i.e. containing the components 9, 9A and 9B in an arrangement capable of bulging are encompassed in item 10.

FIG. 4C shows an expansion of the arrangement illustrated in FIG. 4B. The rear cover of the explosive-comprising area 11 having the individual fields 7 is here carried out by means of a reactively accelerated plate 9 and a bulging arrangement 10 spaced apart from the latter by an intermediate layer 35. Various properties can be assigned to the layer 35. For example, the latter can act as described in FIG. 4B for component 9B. However, it can also consist of a special material or a polymer material that has already proven itself effective on numerous occasions in defending against HL threats. Further, 35 can consist of a shutter-like or fabric-like structure, for example so as to exhibit special damping properties or optimally accelerate the subsequent bulging arrangement in such a way that its effectiveness extends to the HL jet even over an especially long period of time. Given a threat posed by kinetic energy penetrators, an arrangement 10 accelerated in this way can achieve an effect comparable to a homogeneous plate, in that the threat is unable to penetrate the combination 10, and is diverted there by the time dilation, thereby decisively reducing the final ballistic power.

Figure 5:
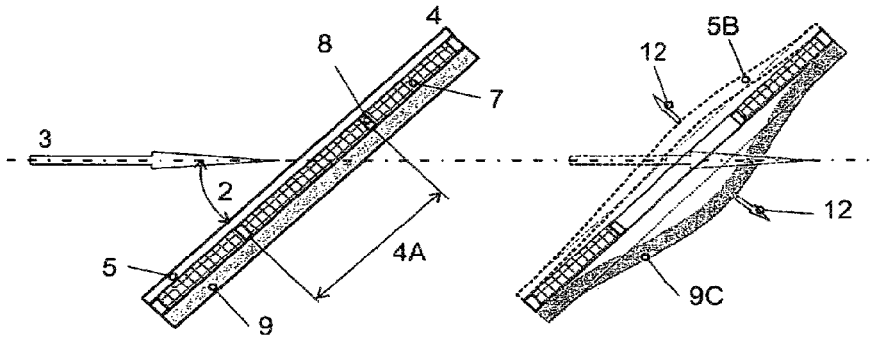
FIGS. 5 to 8 are three views showing the interaction between a protective area 4 and its partial areas 4A and the incident or penetrating threat.
Figure 6:
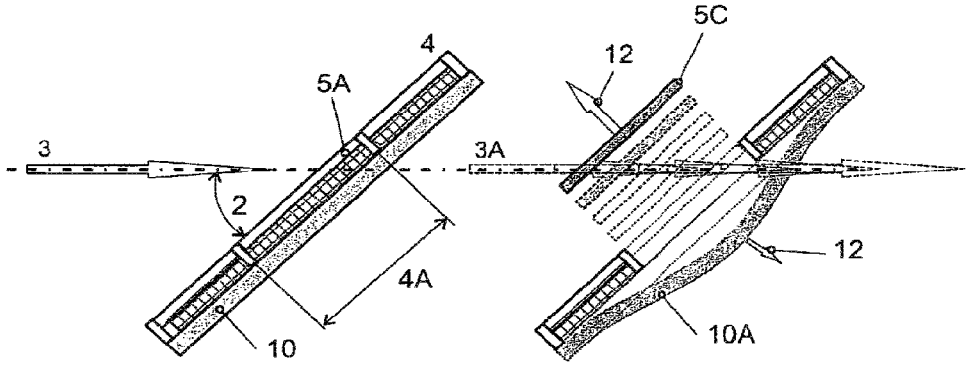
Figure 7:
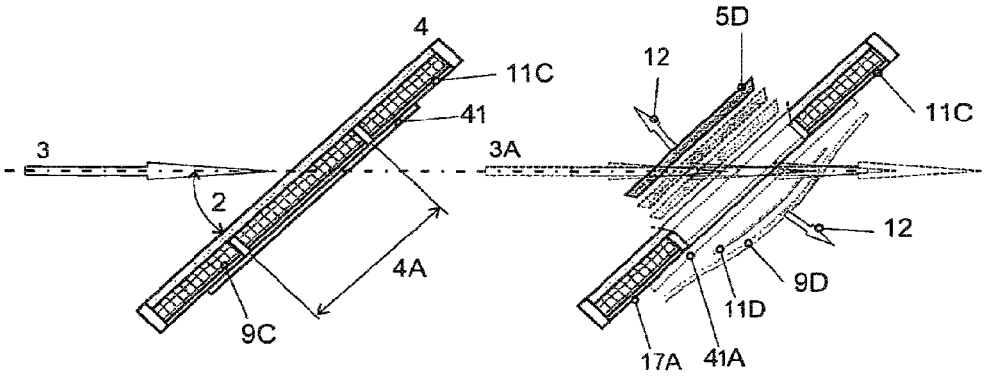

FIGS. 5 to 7 also show the effectiveness of arrangements according to the invention. They illustrate the broad range of application for reactive structures based on the design described above in different reactive protection arrangements. At the same time, the serious differences with respect to known reactive arrangements are made evident. As a result, the presented examples can be expanded as desired, for example by the expert reasonably using or combining the structural designs for the various arrangements depicted in the different figures in such a way that optimal effects can be achieved.

The arrangements described in FIGS. 5 to 7 can also be modified for example by applying linings on both sides of the layer 11 that are stamped out as fields by the detonating explosive. The linings projecting over one, two or all sides of the explosive field or multilayer, partial-areal or full-areal linings can be used in equal measure both in the front and rear regions.

FIG. 5 shows the interaction between a protective area (here based on the example of FIG. 4) with the reactive partial areas 4 having a continuous/full-areal lining on both sides by means of areas 5 and 9 to be accelerated. Detonating the explosive filed 7 accelerates both lining areas (5B or 9C), causing them to laterally graze the penetrating hollow charge jet 3. The arrows 12 symbolize the reactive acceleration or velocity of the accelerated components. In FIGS. 5 to 7, the arrows vary in size, and are thereby intended to highlight the different velocities to be expected for the various arrangements.

FIG. 6 shows the interaction of a protective area 4 with segmented/partial-areal lining (partial area lining) by means of the area elements 4A of the front, accelerated areas via the partial areas 5A as well as a continuous/full-areal rear lining 10. 5C symbolizes the partial area 5A accelerated by the detonation of the explosive field 7. The arrow 12 for the achieved velocity is significantly larger by comparison to FIG. 5, since the lining area of the non-detonating adjacent elements needs here not be also accelerated or entrained. While the invention is basically characterized by the design of the reactive area 11 with the partial fields 4A, arrangements with accelerated partial areas 5A (alternatively or in combination with corresponding partial fields on the rear side of 11) are very effective in particular against hollow charges, due to the very rapid acceleration and very high plate velocity.

Figure 23:
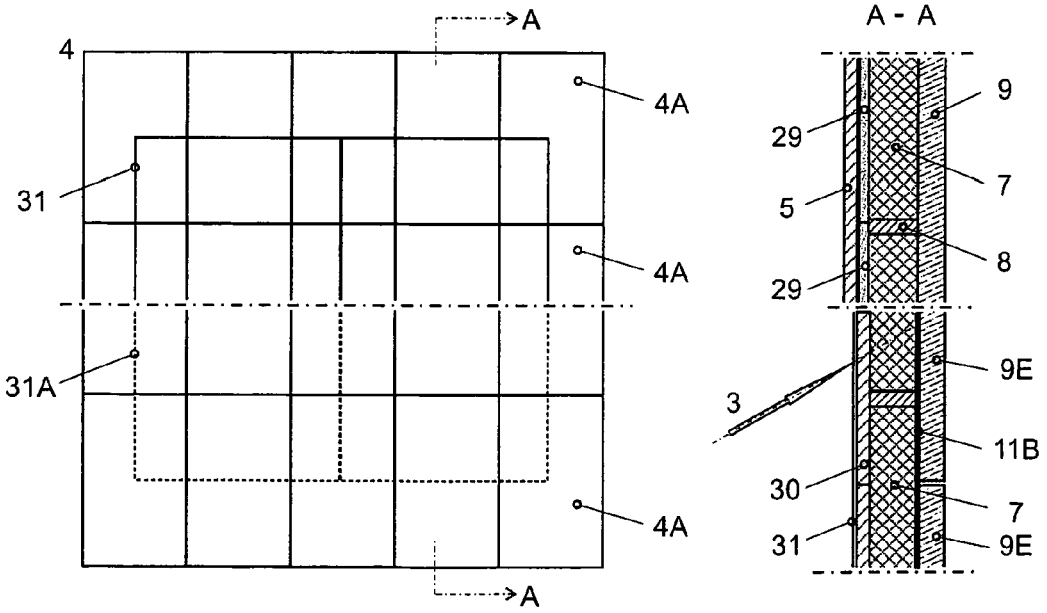
FIG. 23 shows two examples for the structural design of a reactive protective area 4 having reactive area elements 4A (above: double-layer, overlapping front plugging by means of accelerated partial areas 29 and full-areal lining 5; below: double-layer, overlapping front plugging by means of accelerated partial areas 30 and a front cover layer/vulcanization layer 31)

FIG. 7 shows the interaction of a protective area 4 having a continuous, full-areal (whole-areal, areal) lining 5 to be stamped through via the detonation of the explosive and a segmented lining (partial areal lining) of the accelerated, rearward partial areas 9C as well as another, extensive partial area 41 (accelerated area; 41A). FIG. 23 describes such an extensive lining in greater detail.

The final velocity of the stamped out partial area 5D will be somewhat lower in relation to the example of FIG. 6, since energy extracted from the plate 5 must be applied to form the area. However, both experience and simulation calculations have shown that this percentage is substantially smaller than the energy required for accelerating an environment that is also accelerated. The energy required for stamping out can also be controlled by selecting a corresponding material for 9C, as well as in a preliminary fragmentation process, e.g., via linear embrittlement or mechanical measures, such as milled slots.

By comparison to areal linings, the arrangements described in FIGS. 6 and 7 yield much higher disruptive plate velocities, and hence correspondingly higher protective performances. In terms of the velocities of the accelerated areas, the example shown in FIG. 5 is rather comparable to conventional reactive protection arrangements. However, the used and in particular the detonating explosive mass are unevenly lower. Nonetheless, arrangements according to the invention can be used to achieve comparable protective performances, since the outer area portions that are also accelerated usually do not interact with the threat.

Figure 8:
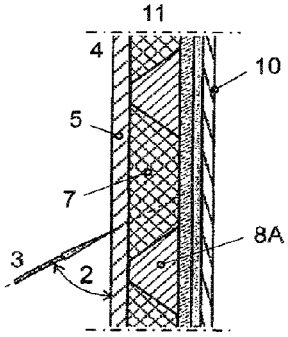

FIG. 8 shows the schematic sectional view of a protective area 4 having the reactive layer 11 and geometrically configured, plugging, lateral separating elements. Shown as an example is an arrangement according to FIGS. 3 and 4 with wedge-shaped webs 8A for the inner plugging of a continuous front, full-areal lining 5 and a rear bulging arrangement 10. Any geometric shapes along with a plurality of materials can be used for 8A; for example, light metal or plastic aside from steel. The sole critical precondition is that the detonation does not spread to the adjacent field(s).

The requirement for inner plugging makes it possible within certain limits to varyingly configure the effect of the explosive detonation in both directions. In the example shown, a larger explosive effect can be expected against the threat direction than in the direction of the bulging sheet arrangement or target.

Configurations of zone 11 not only allow a directional control of the explosive effect, but can rather also help to further diminish the explosive to be used or detonated. This is of interest in particular in conjunction with thicker explosive layers. Basically, the explosive fields 7 can have line-type, rectangular or even free designs.

Figure 9:
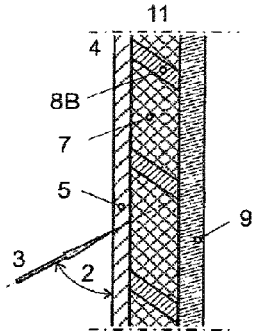
FIG. 9 is a sectional view of a protective area having a reactive layer 11 and geometrically configured, plugging separating elements, wherein the arrangement according to FIGS. 3 and 4A is here provided with adjusted/inclined (horizontal or vertical) plugging webs 8B.

FIG. 9 shows a protective area 4 having the reactive layer and geometrically configured, adjusted/inclined plugging separating elements. Arrangements according to FIGS. 3 and 4A with (horizontal or vertical) plugging webs 8B are depicted.

Figure 10:
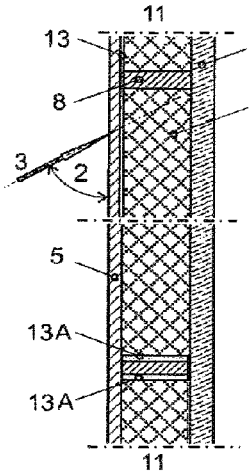
FIG. 10 is a sectional view of two protective areas 4 and 4A having the reactive layer 11 and transitional layers between the plugging components and the explosive 7, wherein a front, areal transitional layer 13 between 5 and 7 is depicted above, and an inner, lateral transitional layer 13A between 8 and 7 is depicted below.

FIGS. 10 to 13 present further configurations of arrangements according to the invention. FIG. 10 shows the sectional view of two protective areas 4 or 4A having the reactive layer 11 and transitional layers between the plugging components and the explosive 7. The upper partial drawing includes a front, areal transitional layer 13 between 5 and 7. This layer 13 can be designed based on the physical requirements placed on the shockwave passage (acoustic impedance) between 7 and 5 or 9. The lower partial drawing depicts a corresponding inner, lateral transitional layer 13A between 8 and 7.

Figure 11:
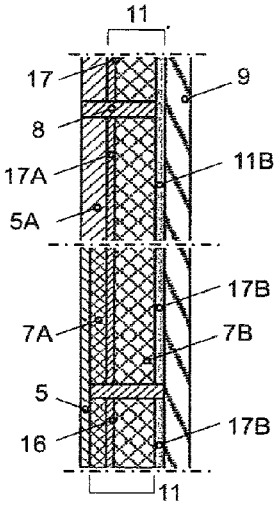
FIG. 11 is a sectional view of two protective areas 4 and 4A having the reactive layer 11 and accelerated, partial-areal or full-areal front elements, as well as a rear lining 9 to be accelerated with a transitional layer (11B or 17A) between 7 and 9, wherein a double lining 17 and 17A of accelerated elements is depicted above, and an intermediate layer 16 between the two explosive areas 7A and 7A is depicted below.
Figure 25:
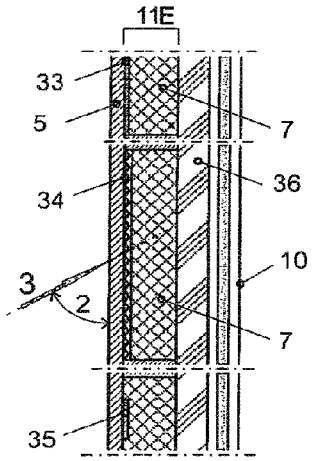
FIG. 25 shows two examples for the structural design of a reactive protector 4 according to the invention having a double-reactive protective layer 11E having an inner separating layer 32 and double-layer/multilayer front and rear plugging by means of partial area elements 5A and 30 to be accelerated.

FIG. 11 shows the sectional view of two protection arrangements 4 and 4A having the reactive layer 11 and accelerated, partial-areal or full-areal front elements, as well as a rear lining 9 to be accelerated with a transitional layer (11B or 17A) between 7 and 9 (upper partial drawing). The lower partial drawing depicts a double-coverage 17 and 17A of the explosive field. An intermediate layer 16 can be located between the two explosive areas 7A and 7B as a separation or reaction layer, for example in the sense of an initiation aid for the two explosive components (see FIG. 25).

Figure 12:
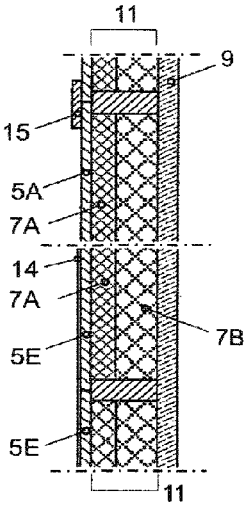
FIG. 12 shows two examples for front partial area linings 4A and their attachment/arrangement via double explosive fields 7, 7A, wherein a partial area lining 5A with clamping strips/fastening strips/fastening elements 15 is depicted above, and an arrangement as above is depicted below, but with (e.g., adhesively bonded or vulcanized) partial elements 5A and an outer cover layer/protective layer 14.

FIG. 12 presents two examples for front partial area coverages 4A and their attachment/arrangement via what are here double explosive fields 7, 7A. The partial area lining 5A is fixed in place with a clamping strip/fastening strip/fastening element in the upper partial drawing. The lower partial drawing shows a comparable arrangement, but having (for example, adhesively bonded or vulcanized) partial elements 5A and an outer cover layer 14. 14 can also be the wall of a container or housing, or a carrier element (cf. FIG. 27).

Figure 13:
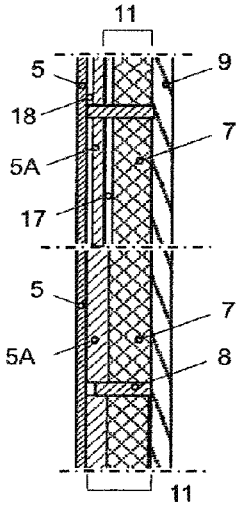
FIG. 13 is a sectional view of two other protection arrangements with multilayer, reactively accelerated partial area elements and lateral plugging 8, wherein a partial area lining of the reactive layer 11 with partial areas 5A and an areal front cover 5 spaced apart (and if necessary also fixed in place) by means of 8 are depicted above, and an arrangement according to FIG. 12 is depicted below, but with shorter inner pluggings 8 so that 5 or 5A can be pressed onto 7.

FIG. 13 shows the sectional view of two further examples with multilayer, reactively accelerated partial area elements and lateral plugging 8. A partial area lining of the reactive layer 11 with partial areas 5A and an areal front cover 5 spaced apart (if necessary also fixed in place) by means of 8 is carried out in the upper partial drawing. The lower partial drawing depicts an arrangement according to FIG. 12, but with shorter inner pluggings 8 so that 5 or 5A can be pressed onto 7.

As follows from the described geometric properties of protective areas according to the invention, nearly no limits are placed on the configuration of these types of reactive protective areas. The protector can be adjusted to any surface shape. A protective area can also be configured with various partial elements.

Figure 14:
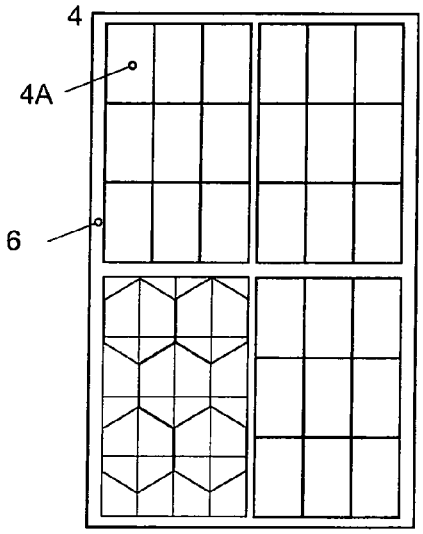
FIG. 14 shows a structural design of a protective area 4 according to the invention comprised of explosive-comprising fields 4A with the same or different structural design, and an outer plugging/an outer attachment frame 6.
Figure 15:
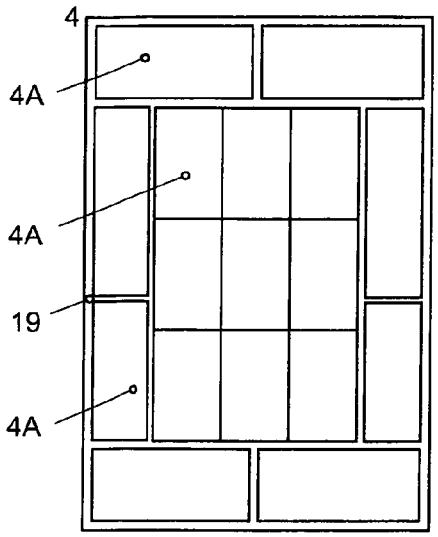
FIG. 15 shows another example for the structural design of a protective area 4 comprised of explosive-comprising fields 4A differing in size or even differing in structural design (for example, individually or combined into groups)

FIGS. 14 and 15 show two reactive protective areas having differing partial area fields. FIG. 14 presents an example for the structural design of a protective layer 4 comprised of explosive-comprising fields 4A with the same or different structural design, and an outer plugging/an attachment frame 6.

FIG. 15 presents another example for the structural design of a protective layer 4 comprised of explosive-comprising fields 4A differing in size or even differing in structural design (for example, individually or combined into groups).

In protective areas according to the invention, the object to be protected basically has placed offshore a reactive protection arrangement, which is adjusted relative to the threat direction in the area where it will hit. As already explained, the angle of this inclination/adjustment preferably ranges between 30° and 45°. However, depending on field size, it can be designed between 20° and 70°. The angle or range of angles to be selected is derived from the velocities to be expected for the accelerated elements and the area of the object to be protected that is to be covered by an area element.

This reactive protection arrangement can extend as an even structure over the entire target surface, for example in the form of the protective area depicted in FIGS. 14 and 15, or be composed of several individual protective areas 4. FIGS. 16 to 20 present examples for this.

Figure 16:
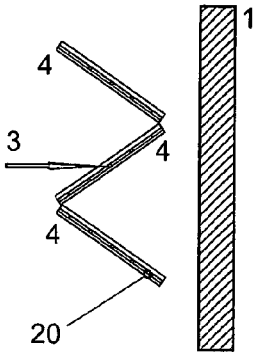
FIG. 16 shows the structural design and arrangement of a reactive protective area/protective plane according to the invention having areas comprised of reactive elements 4, wherein a single-layer structural design of the reactive protective area 20 made up of angled partial elements 4 is depicted here.

For example, FIG. 16 presents an example for the structural design of an arrangement of a reactive protective area/protective plane according to the invention by means of an area comprised of reactive elements 4. Involved here is a single-areal structural design 20 comprised of angled partial elements 4.

Figure 17:
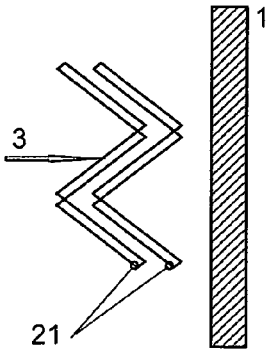
FIG. 17 shows parallel, reactive protective areas 21 (e.g., according to FIG. 16)
Figure 18:
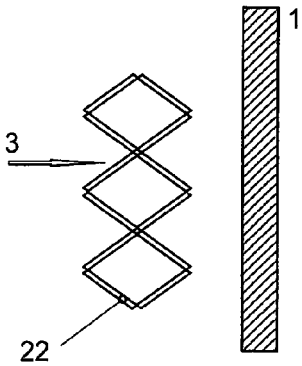
FIG. 18 shows a double-layered, mirror-inverted reactive protective area 22 (for example according to FIG. 16)

FIG. 17 presents an example corresponding to FIG. 16, but with parallel, reactive protective areas 21. A plurality of other arrangements and combinations of such partial areas 4 is conceivable, which permit an optimal adjustment to the object to be protected. For example, FIG. 18 presents another example for the structural design and arrangement of a reactive protective area, comprised of a double-layer structure of mirror-inverted, reactive protective areas 22 (e.g., corresponding to FIG. 16).

Figure 19:
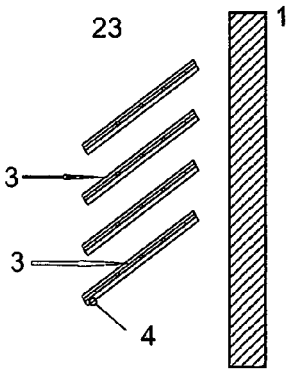
FIG. 19 shows a protective area/protective plane/protective zone having a shutter-like structural design.

In FIG. 19, the protective area/protective plane/protective zone having the individual reactive protective components 4 exhibits a shutter-like structural design 23. As a consequence, the target area can be completely covered without inert weak points, as illustrated by the two arrows symbolizing the incident threat (cf. also FIG. 20).

Figure 20:
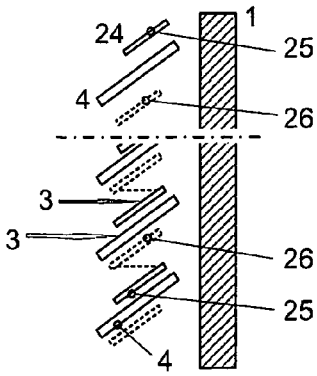
FIG. 20 shows a protective structure with a shutter-like, offshore reactive protective area 24, comprised of the reactive protective areas 4 in combination with the also reactive areas 25 and/or 26 (above: partial areas 4, 25 and 26 spaced more apart from each other; below: partial areas 4, 25 and 26 together form a combined protective layer)

FIG. 20 depicts two further examples. Involved here are protective structures having shutter-like, offshore, reactive protective areas 24, comprised of the reactive protective areas 4 in combination with the also reactive areas 25 and/or 26 for achieving a reliable degree of coverage, and hence a reliable absorption of power independently of where the threat hits. The partial areas 4, 25 and 26 are spaced more apart from each other in the upper partial drawing, while the partial areas 4, 25 and 26 together form a combined protective structure in the lower partial drawing.

Figure 21:
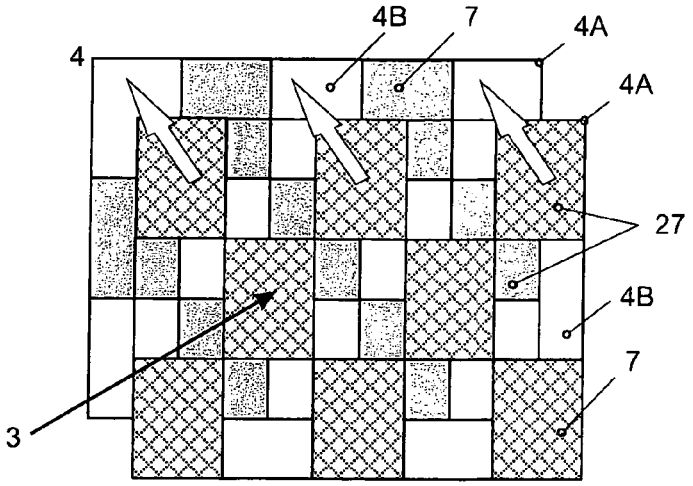
FIG. 21 shows a protection arrangement having two protective areas 4 having explosive-comprising fields 4A and inert/explosive-free fields 4B in a checkerboard, mutually enhancing/overlapping coverage 27.

One special advantage to the reactive partial areas is that they can be optimally combined in multilayer arrangements. This also enables the use of reactive protective areas with a particularly low explosive content or low explosive coverage. For example, FIG. 21 shows a schematic view of a protection arrangement with two protective layers 4 having explosive-comprising fields 4A and inert/explosive-free fields 4B in a checkerboard, mutually enhancing/overlapping coverage 27. In this way, the area is completely covered with explosive-comprising areas, wherein the reactive fields are surrounded by inert fields.

Figure 22:
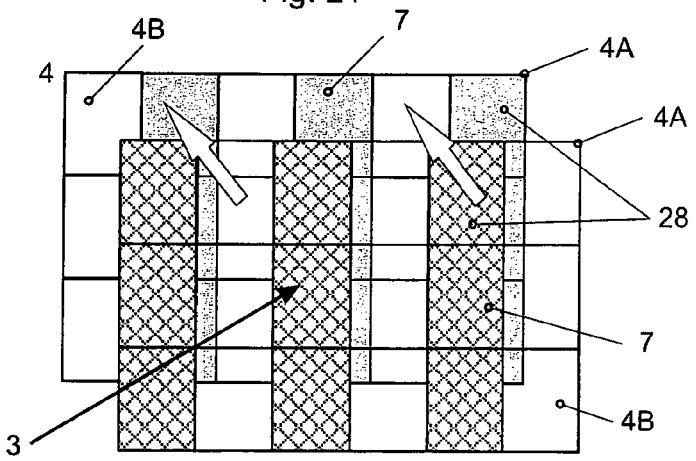
FIG. 22 is a view of a protection arrangement having two protective areas 4 having explosive-comprising fields 4A and inert/explosive-free fields 4B in a strip-type, mutually enhancing coverage 28.

FIG. 22 presents another example. Involved here is a protection arrangement having two protective layers 4 having explosive-comprising strips 4A and inert/explosive-free strips 4B in a strip-type, mutually enhancing coverage 28.

Since the reactively covered partial fields 4A of the present invention can be extremely small in comparison to conventional reactive armor, edge hits or edge-proximate hits become increasingly important. Depending on the range of application, it is thus advantageous to also adapt the configuration of the sheets or areas to be accelerated to edge-proximate hits or even to hits in the edge area. This is especially easy to accomplish, since both accelerated components with the size of individual fields as well as linings with a larger area can be used. However, the latter must be dimensioned in such a way as not to significantly diminish the velocity.

FIG. 23 presents two examples for the structural design of a reactive protective area 4 having reactive area elements 4A with overlapping coverings for the respective explosive fields. The upper partial drawing depicts a double-layer, overlapping front plugging by means of accelerated partial areas 29 and full-areal lining 5. The lower partial drawing involves a double-layer, overlapping front plugging by means of accelerated partial areas 30 and a front cover layer/vulcanization layer 31, as well as a rear area 9E that clearly projects over the field 4A.

Figure 24:
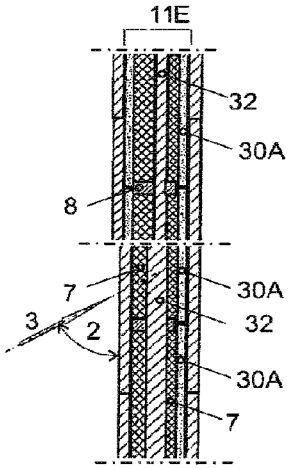
FIG. 24 shows a structure comprised of two reactive areas A and B offset by 90 degrees, having a strip-type, single-layer coverage.

FIG. 24 shows further characterizing examples for the configuration of arrangements according to the invention. It depicts the schematic sectional view of two examples for the structural design of a reactive protector 4 having a double-reactive protective layer (marked 11E similarly to 11) and an inner separating layer 32 that is relatively thick in comparison to a pure separating layer (see FIG. 11) (upper partial drawing) or an especially thick separating layer 32 (lower partial drawing) and double-layered/multilayered front and rear plugging by means of partial-area elements to be accelerated 5A and 30, which both project over the area of the explosive 7.

Such massive components between the explosive areas 7 and 7A serve to even further improve the explosive plugging. This is because massive borders plug the detonating explosive more efficiently than the inherent plugging of the explosive itself. Such arrangements enable the realization of very thin explosive fields measuring on the order of about 1.5 to 3 mm, wherein a reliable through-initiation still takes place.

For reasons specific to application and to ensure the safest possible handling, it is advantageous to use slow explosives. However, their initiation by the incident threat must be assured. The initiation can be supported by means of various aids depicted in FIG. 25, for example. Three examples for initiation aids are shown. In the upper partial drawing, an initiation-supporting pyrotechnic layer is provided between 5 and 7. In the middle partial drawing, the initiation-supporting device consists of a mechanical arrangement 34 between 5 and 7. In the lower partial drawing, the initiation-supporting element (e.g., the squib) 35 is embedded in the explosive 7. However, such initiation elements can also be integrated into 5, or be located in a special, autonomous intermediate layer. To improve handling safety, for example, the initiation elements can be modular in design, i.e., addable and removable. These examples also show a layer 36 that transmits shock-waves or even diminishes (scatters) the detonation effect, which is spaced apart from the explosive, as opposed to the example depicted on FIG. 4C.

Figure 26:
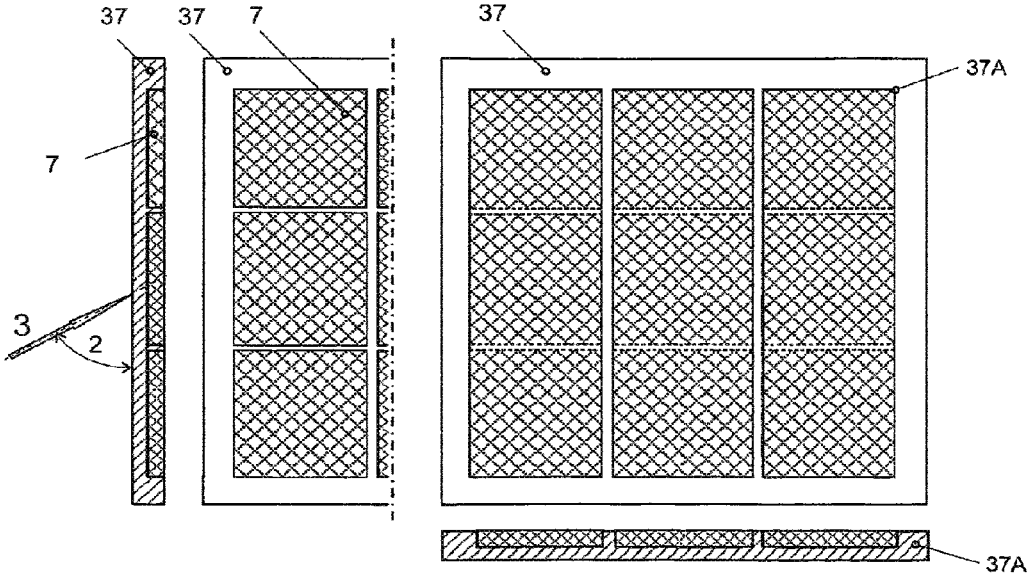
FIG. 26 shows three examples for initiation aids (above: initiation-supporting pyrotechnic layer 33 between 5 and 7; middle: initiation-supporting mechanical arrangement 34 between 5 and 7; below: initiation-supporting element (e.g., squib) 35, embedded in 7 (can also be integrated into 5 or into a special intermediate layer)), wherein a layer 36 that transmits shock or even diminishes (scatters) the detonation effect is provided between the explosive and the bulging arrangement 10 in these examples.

FIG. 26 presents a structure comprised of two reactive areas A and B offset by 90°, with strip-type, single-layer coverages. The fields for accommodating the explosive are here milled completely or partially into the plates. Let it be noted at this point that the explosive fields need not have a square configuration, but can instead exhibit any contour desired. It must only be ensured that a large enough partial area is accelerated by the corresponding explosive field.

In describing the invention, examples have thus far been shown for arrangements whose design does not take into account the carrying elements, fastening elements and additional components, for example the housing or other walls. However, it may be advantageous relative the system as a whole for such elements to contribute to the overall protective effect.

Figure 27:
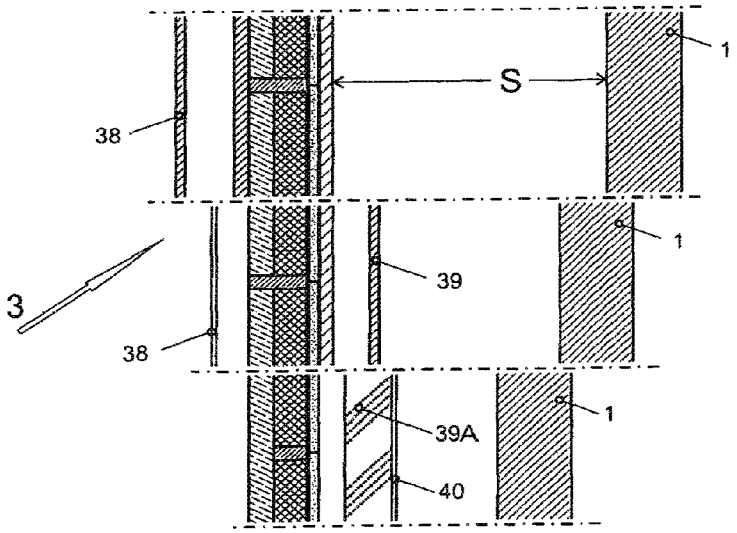
FIG. 27 shows three examples for protective areas with differently positioned, additional protective layers, walls or containers (above: upstream layer 38 spaced apart in relation to the reactive protective zone; middle: structural design as above, but with an additional layer between the reactive protection zone and the target 1; below: double-layered arrangement between the reactive layer and the target 1).

FIG. 27 shows three examples for protective structures having differently positioned, additional protective layers, walls or containers. The upper partial drawing depicts an upstream layer 38 spaced apart in relation to the reactive protective zone. The middle partial drawing depicts the same structural design as above, but with an additional layer 39 between the reactive protective zone and the target 1. Such a device between the reactive area 4 and target surface can help impart more lateral forces to the disrupted jet of a hollow charge as it penetrates through the plate 39, thereby deflecting it to the side even more efficiently. For example, this makes it possible to shorten the distance S between the reactive zone and the target at the same protective performance. The lower partial drawing depicts a further possible configuration with a shallowest possible target depth. It shows a double-layer arrangement with the components 39A and 40 between the reactive plane 4 and the target 1. The final ballistic properties of the plate 40 can be estimated based on already existing results for inert targets against the various threats, whereupon the plate 40 can be configured accordingly.

REFERENCE LIST

1 Object to be protected/target
2 Angle between the threat direction and reactive protection arrangement
3 Threat/threat direction
4 Protection arrangement/protective area comprised of individual fields 4A
4A Reactive protective field/reactive partial field/reactive partial area
4B Inert partial area
5 Front cover/protective plate/carrier plate or front, reactively accelerated plate on the threat side
5A Front partial area lining (corresponding to 5)
5B Reactively accelerated plate 5
5C Reactively accelerated plate 5A
5D Partial area of 5 stamped out by the detonation
5E Reactively accelerated partial area that partially overlaps (the web 8)
6 Outer plugging/edge layer/outer border of 4 or 4A
7 Explosive field/pyrotechnic element/pyrotechnic zone
7A Front explosive field/front pyrotechnic element (in the case of double configuration)
7B Rear explosive field/rear pyrotechnic element (in the case of double configuration)
8 Inner plugging between the explosive fields/separating layer
8A Geometrically configured inner plugging between the explosive fields
8B Angled/adjusted horizontal (or vertical) inner plugging
9 Rear, reactively accelerated cover or plate of 4 or 4A
9A Second rear reactively accelerated plate of 4 or 4A
9B Layer between 9 and 9A
9C Element/plate 9 to be reactively accelerated
9D Accelerated element 9C
9E Explosive field with partial area overlapping the inner pluggings
10 Bulging plate/bulging combination/bulging arrangement (comprised of 9, 9A and 9B)
10A Element/bugling plate 10 to be accelerated
11 Middle layer/reactive zone/reactive area/reactive area element
11A Front cover/front cover layer of 11
11B Rear cover/rear cover layer of 11
11C Reactively accelerated element 11C
11D Reactively accelerated element 11C
11E Double-reactive layer
12 Velocity arrow
13 Intermediate layer between 5 and 7
13A Lateral boundary layer of 7 in conjunction with 8
14 Outer cover layer/vulcanization layer/explosive cover
15 Retaining strip/fastening element/clamping element/non-positive or positive bracket
16 Separating layer/intermediate layer between 7A and 7B
17 Intermediate layer between 7 and 17A
17A Reactively accelerated component of 4A/reactively accelerated partial area
18 Distance between 5 and 5A
19 Frame/outer border of protective area 4
20 Reactive protective zone with angled individual fields 4A
21 Reactive protective zone comprised of two parallel protective elements corresponding to 20

22 Reactive protective zone with two mirrored protective elements corresponding to 20

23 Reactive shutter comprised of elements 4 or 4A

24 Reactive shutter comprised of different elements 4 or 4A

25 Front reactive shutter element comprised of elements corresponding to 4A

26 Rear reactive shutter element comprised of elements corresponding to 4A

27 Checkerboard configuration of the areas 4 with explosive fields 4A and inert fields

28 Strip-type arrangement of explosive fields corresponding to 4

29 Front/threat-side partial cover

30 Accelerated partial area

30A Reactively accelerated rear partial area element (overlapping the explosive field 7)

31 Outer cover/cover film

32 Separating plate/carrier plate

33 Areal initiation aid

34 Mechanical initiation aid

35 Local/pill-like initiation aid

36 Layer between 7 and 10

37 Protective zone according to the invention with (in this case three) explosive-lined strip elements

37A Second reactive element turned by 90° relative to 37

38 Offshore sheet/front housing wall/offshore target

39 Protective element positioned in front of 1/rear housing wall

39A Shutter-like deflection layer/shock-reducing layer

40 Layer

41 Second, rear reactively accelerated (overlapping) partial area

41A Accelerated element 41

The invention claimed is:

1. A reactive protection arrangement for protecting stationary or mobile objects against threats posed by hollow charges, projectile-forming charges or kinetic energy penetrators, which is or can be secured at a distance to the side of the object to be protected that faces the threat, comprising at least one protective area arranged at an inclination angle relative to the threat direction, wherein said protective area comprises:

a front cover that faces the threat, a rear cover that faces away from the threat and is spaced apart from said front cover, said rear cover comprises a bulging arrangement, and at least one fixed or movable reactive middle layer between said front cover and said rear cover, and wherein said at least one reactive middle layer comprises a plurality of reactive partial areas or elements each having at least one explosive field, and wherein said reactive partial areas or elements of said at least one reactive middle layer are plugged on all sides; and wherein said front cover is configured to continuously extend over a plurality of reactive partial areas or elements of said at least one reactive middle layer, such that, when a reactive partial area or element of said at least one reactive middle layer is detonated, a partial area corresponding to the size of the detonated reactive partial area or element is stamped out of said front cover and is accelerated to interact with said threat.

2. The protection arrangement according to claim 1, wherein said reactive partial areas or elements of said at least one reactive middle layer are laterally plugged by means of separating layers.

3. The protection arrangement according to claim 1, wherein said reactive partial areas or elements of said at least one reactive middle layer comprise at least two plies of explosive fields plugged laterally on all sides.

4. The protection arrangement according to claim 1, wherein an intermediate layer is arranged between said reactive middle layer and said rear cover.

5. The protection arrangement according to claim 1, wherein a boundary layer is at least partially arranged between one reactive partial area or element and one separating layer that laterally plugs the latter in order to influence the boundary layer reflections.

6. The protection arrangement according to claim 1, wherein the protection arrangement comprises at least two protective areas arranged one behind the other in the threat direction, each having strip-type reactive partial areas or elements, wherein the strips of the reactive partial areas or elements of a rear protective area are offset relative to the strips of the reactive partial areas or elements of a front protective area.

7. The protection arrangement according to claim 1, wherein the protection arrangement comprises at least two protective areas arranged one behind the other in the threat direction, each having checkerboard reactive partial areas or elements, wherein the reactive partial areas or elements of a rear protective area are essentially offset relative to the reactive partial areas or elements of a front protective area.

8. The protection arrangement according to claim 1, wherein a plurality of protective areas is arranged in the form of a shutter.

9. The protection arrangement according to claim 1, wherein a plurality of protective areas is arranged at an angle relative to each other.

10. The protection arrangement according to claim 1, wherein an additional layer for disrupting a (residual) threat penetrating through said at least one protective area is arranged between said at least one protective area and the object to be protected, with or without a gap relative to the object to be protected and/or said at least one protective area.

11. The protection arrangement according to claim 1, wherein said at least one protective area is movably arranged.

12. The protection arrangement according to claim 1, wherein said reactive partial areas or elements of said at least one middle layer are replaceable.

13. The protection arrangement according to claim 1, wherein said reactive partial areas or elements of said at least one middle layer are rotatable or have an adjustable inclination.

14. The protection arrangement according to claim 1, wherein said reactive partial areas or elements and/or said explosive fields are pyrotechnically interlinked.

15. The protection arrangement according to claim 1, wherein said front cover essentially consists of a material that, in light of its thickness and/or its mechanical properties during the detonation of the explosive, is stamped out essentially corresponding to the size of said reactive partial area or element.

16. The protection arrangement according to claim 1, characterized in that said bulging arrangement of said rear cover is configured to continuously extend over a plurality of reactive partial areas or elements of said at least one reactive middle layer.

17. A reactive protection arrangement for protecting stationary or mobile objects against threats posed by hollow charges, projectile-forming charges or kinetic energy penetrators, which is or can be secured at a distance to the side of the object to be protected that faces the threat, comprising at least one protective area arranged at an inclination angle relative to the threat direction, wherein said protective area comprises:

a front cover that faces the threat, a rear cover that faces away from the threat and is spaced apart from said front cover, said rear cover comprises a bulging arrangement, and at least one fixed or movable reactive middle layer between said front cover and said rear cover, wherein said at least one reactive middle layer comprises a plurality of reactive partial areas or elements each having at least one explosive field, wherein said reactive partial areas or elements of said at least one reactive middle layer are plugged on all sides, wherein said front cover is configured to continuously extend over a plurality of reactive partial areas or elements of said at least one reactive middle layer, and said bulging arrangement of said rear cover is configured to continuously extend over a plurality of reactive partial areas or elements of said at least one reactive middle layer, such that, when a reactive partial area or element of said at least one reactive middle layer is detonated, a partial area corresponding to the size of the detonated reactive partial area or element is formed out of said front cover and is accelerated to interact with said threat.

* * * * *